US010782111B1

(12) United States Patent
Boyajian

(10) Patent No.: US 10,782,111 B1
(45) Date of Patent: Sep. 22, 2020

(54) AMMUNITION HOLSTER

(71) Applicant: William Boyajian, Methuen, MA (US)

(72) Inventor: William Boyajian, Methuen, MA (US)

( * ) Notice: Subject to any disclaimer, the term of this patent is extended or adjusted under 35 U.S.C. 154(b) by 0 days.

(21) Appl. No.: 16/811,535

(22) Filed: Mar. 6, 2020

Related U.S. Application Data

(60) Provisional application No. 62/833,187, filed on Apr. 12, 2019.

(51) Int. Cl.
*F42B 39/02* (2006.01)
*F42B 39/08* (2006.01)
*F41C 33/02* (2006.01)

(52) U.S. Cl.
CPC ..... *F42B 39/02* (2013.01); *F41C 33/02* (2013.01); *F42B 39/08* (2013.01)

(58) Field of Classification Search
CPC ..... F42B 39/02; F42B 39/002; F42B 39/26; A45F 2200/0591; Y10S 224/931
See application file for complete search history.

(56) References Cited

U.S. PATENT DOCUMENTS 109,365 A 11/1870 King
629,908 A * 8/1899 McClean ..... A45F 3/02 224/603
1,845,705 A 2/1932 Franz
1,891,437 A 12/1932 Milmore
2,305,198 A * 12/1942 Shonblom ..... B65D 5/38 206/3
2,592,415 A 4/1952 Grogan
2,763,411 A 9/1956 Werner
3,066,791 A 12/1962 Bivens
3,213,559 A 10/1965 Matich
3,538,636 A * 11/1970 Roth ..... F41A 9/84 42/87
3,890,733 A 6/1975 Kubik
4,004,683 A * 1/1977 Pomeroy ..... B65D 83/0472 206/3
4,262,833 A 4/1981 DeSantis
4,572,415 A * 2/1986 Fehr ..... F41A 9/85 224/675

(Continued)

OTHER PUBLICATIONS

International Search Report from PCT/US2020/023322, dated Jun. 25, 2020.

*Primary Examiner* — Justin M Larson
(74) *Attorney, Agent, or Firm* — Morse, Barnes-Brown & Pendleton, P.C.; Sean D. Detweiler, Esq.

(57) ABSTRACT

An ammunition holster that provides for the storage and deployment of ammunition for reloading incorporating a strip style loader. The holster includes a main body, makes use of the strip loader with an elongate pull tab, and further includes a flexible flap and gate wall. The main body comprises an open ended box configured to contain and stow a loaded strip loader. The elongate pull tab is attached to the tab end of the strip loader to provide a larger gripping area for the extraction of the strip loader from the main body. The flexible flap and gate wall attach to the main body to enclose the open ends of the box of the main body while the flexible nature of the flap allows the gate wall enclosing one open end of the main body to swing away to allow the extraction of the strip loader using the elongate pull tab attached to the strip loader.

21 Claims, 19 Drawing Sheets

(56) References Cited

U.S. PATENT DOCUMENTS

| | | | | |
|---|---|---|---|---|
| 5,152,442 | A * | 10/1992 | Gallagher | A45F 5/02 206/3 |
| 5,450,947 | A * | 9/1995 | Sgueglia, Sr. | B65D 85/20 206/3 |
| 5,924,613 | A * | 7/1999 | Johnson | A45F 5/02 2/94 |
| 6,688,504 | B1 * | 2/2004 | Kirkaldy | F42B 39/02 224/196 |
| 6,779,654 | B1 * | 8/2004 | Marquis | B65D 43/12 206/223 |
| 6,799,500 | B1 * | 10/2004 | Kulikowski | F41A 9/79 89/1.1 |
| 6,874,618 | B1 * | 4/2005 | Cragg | F42B 39/02 206/3 |
| 7,918,048 | B2 * | 4/2011 | Austin | F41A 9/85 221/279 |
| 8,231,038 | B2 | 7/2012 | Felts | |
| 8,613,157 | B2 | 12/2013 | McCaffery | |
| 9,644,910 | B2 * | 5/2017 | Kim | F41A 9/83 |
| 10,222,156 | B2 * | 3/2019 | Head | F41A 9/85 |
| 2014/0202884 | A1 | 7/2014 | Martin, III | |
| 2016/0010968 | A1 * | 1/2016 | Jacques | F42B 39/02 224/660 |
| 2018/0252510 | A1 * | 9/2018 | Varao | F42B 39/02 |

* cited by examiner

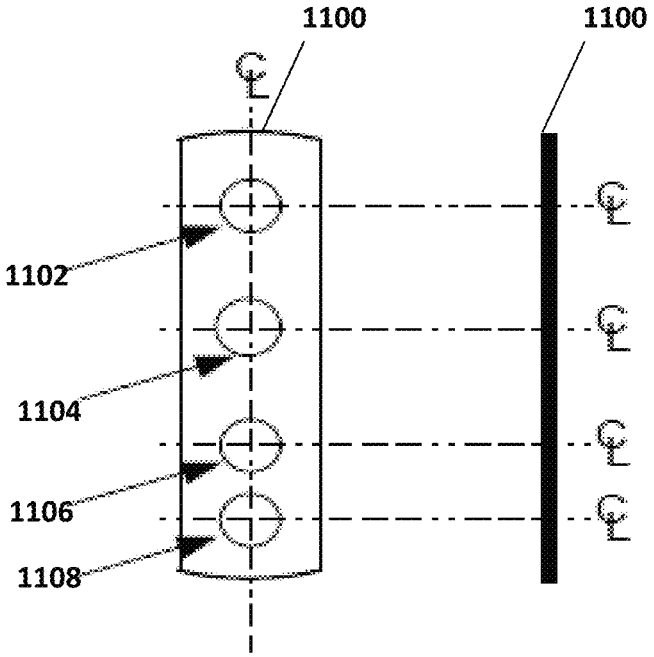
*Fig. 11A* *Fig. 11B*

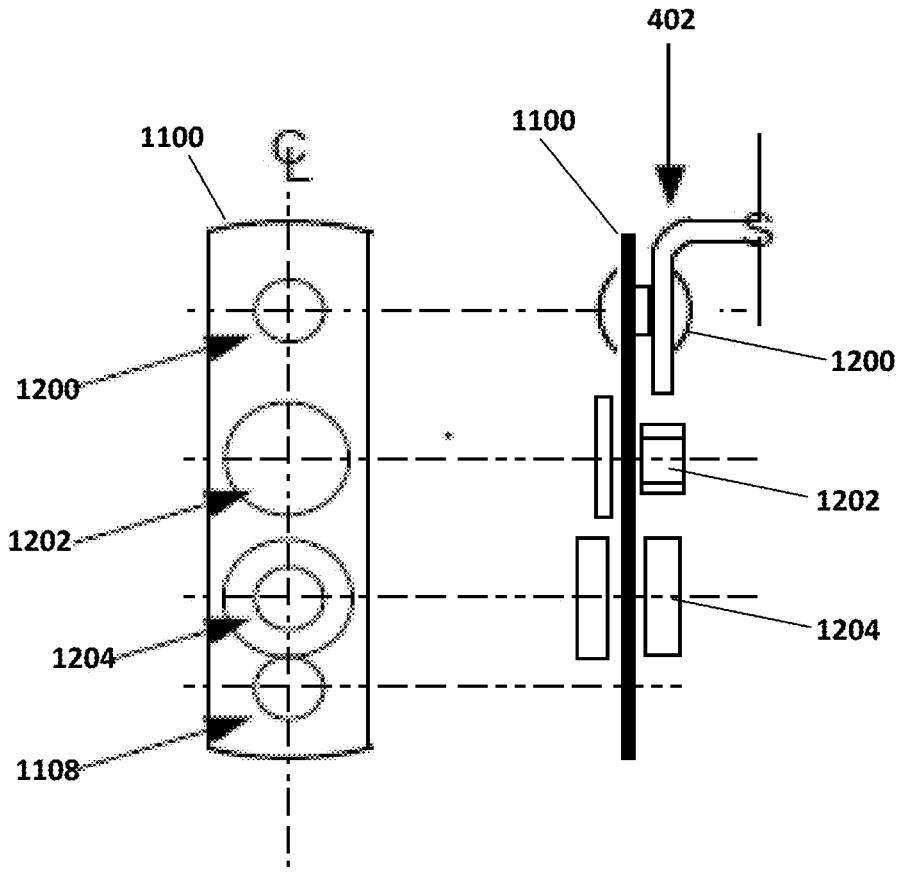
*Fig. 12A* *Fig. 12B*

AMMUNITION HOLSTER

RELATED APPLICATIONS

This application claims priority to, and the benefit of, U.S. Provisional Application No. 62/833,187 filed Apr. 12, 2019 for all subject matter contained in said application. The disclosure of said provisional application is hereby incorporated herein by reference in its entirety.

FIELD OF THE INVENTION

The present invention relates to an ammunition holster suitable for storing and dispensing ammunition cartridges in conjunction with a strip style loader. In particular, the present invention relates to a storage solution that allows for the convenient carrying and deployment of ammunition using a strip loader.

BACKGROUND

Generally, while revolvers remain a popular option for a handgun, they do present some limitations. One such limitation is the speed for reloading the revolver. To address this limitation, speed loaders have been developed. These speed loaders hold cartridges of ammunition in a configuration adapted to the cylinder of the revolver. Typically, these speed loaders come in two varieties: circular or strip. The circular variety speed loader holds the cartridges in a circular arrangement and spacing so as to align the cartridges with the circular arrangement and spacing of ammunition chambers of the cylinder of the revolver. The flexible strip style loader holds the cartridges in a linear arrangement and spacing so as to align two adjacent cartridges on the strip with the spacing of two adjacent ammunition chambers in the circular arrangement of chambers of the cylinder of the revolver. An example of such a strip loader is the Speed Strip™ manufactured by Bianchi International.

While such strip loaders provide an improvement in the arrangement and handling of ammunition for reloading purposes over manually reloading with individual loose cartridges, they still possess some limitations. Namely the storage and handling of the strip loader once populated with cartridges of ammunition. Typically, once populated, a strip loader only provides a small tab at one end of the strip for handling and proper orientation of the populated strip loader. This small tab can be difficult to grip and use, especially if the user is trying to use the strip loader one-handed without visual confirmation. Furthermore, if a user attempts to extract a populated strip from a pocket, pouch, or other container, the cartridges of the populated strip loader can snag or otherwise get entangled with the pocket or container, as well as other cartridges and/or strip loaders in the pocket or container. These complications in the handling of the strip loader can cause a delay in deployment and possibly loss of cartridges from the populated strip loader. Such delay or loss of cartridges is detrimental in situations where fast and effective reloading is paramount.

SUMMARY

There is a need for a mechanism for storing and carrying a loaded strip loader in in such a way that avoids the above shortcomings related to storage and deployment of flexible strip loaders. The present invention is directed toward further solutions to address this need, in addition to having other desirable characteristics. Specifically, an ammunition holster of the present invention enables the storage, rapid extraction, and deployment of a cartridge populated strip loader stored in the holster in such a way that a user can operate the holster and deploy the strip loader one handed without visual confirmation.

The ammunition holster of the present invention provides a belt mounted location that is much more readily accessible than putting the loaded strip loader in a pocket. Further, when extracted, the strip loader is in the closest proximity to the firearm ready for loading. In use, a natural hand motion with no contortions required places the elongate pull tab, or extension, of the strip loader in the hand in such a way that extraction is optimized. Once extracted, the elongate pull tab and strip loader are in the ideal hand position for loading.

The ammunition holster of the present invention provides a discrete, minimalistic, lightweight and durable mechanism for holding and dispensing a strip loader. The operable flap is reversible, enabling the case to be worn on the left side and drawn with the right hand; right side and drawn with the left hand; and in the small of the back drawn with either hand. The contents of the holster are very secure. Because of the 90 degree corners of the gate wall and operable flap, it is extremely difficult to shake the contents out of the case—they must be extracted by intentionally pulling on the pull tab thereby forcing the gate wall open from the inside by applying pressure with a rounded impact surface of a front edge of the strip loader when it is drawn out of the holster during extraction.

In accordance with example embodiments of the present invention an ammunition holster is provided. The ammunition holster includes a main body, a horizontal support edge, a first opening at the first end of the main body; a rubbery and flexible strip loader, an elongate pull tab, and a semi-rigid and flexible flap with gate wall.

The main body is a generally cuboid shaped main body having a first end, a second end opposite the first end, and at least four walls defining an interior volume. The four walls comprise an elongate top wall, which intersects with and is generally orthogonal to a first side wall, which intersects with and is generally orthogonal to an elongate bottom wall, which intersects with and is generally orthogonal to a second side wall, which intersects with and is generally orthogonal to the elongate top wall, thus forming an enclosed main body. The top wall and the bottom wall are opposite each other and generally planar parallel with each other while the first side wall and the second side wall are opposite each other and generally planar parallel with each other.

The horizontal support edge is featured on an interior face of the first and/or second side wall between the first end of the main body and the second end of the main body.

The rubbery and flexible strip loader is removably, replaceably, and slidably mounted inside the interior volume of the main body in a fully stowed position. The flexible strip loader is supported and positioned by the horizontal support edge inside the main body. The interior volume is configured, sized, and dimensioned, to receive the flexible strip loader with a plurality of cartridges of ammunition loaded thereon to be completely enclosed by the main body.

The elongate pull tab extends from a first end of the flexible strip loader. The elongate pull tab is sized, dimensioned, and configured in such a way as to extend outside of the interior volume when the flexible strip loader is in the fully stowed position inside the main body.

The semi-rigid and flexible flap with gate wall is coupled with the main body proximal to the second end. The gate wall extends orthogonal to the flap and is sized, dimensioned, and configured to cover the first opening at the first end of the main body when the flexible flap is in an un-flexed state. The gate wall pulls away and is sized, dimensioned, and configured to uncover the first opening at the first end of the main body when the flexible flap is in a fully flexed state.

In operation, pulling on the elongate pull tab causes the strip loader to slide outward from the fully stowed position inside the main body, an impact surface of the strip loader impacting and pushing aside the gate wall of the flexible flap and transitioning the flexible flap from the un-flexed state to the fully flexed state as the strip loader is further extracted from the main body until the strip loader is fully extracted and un-stowed from the main body at which time the flexible flap transitions back to the un-flexed state covering the first opening at the first end of the main body.

In accordance with an aspect of the invention, the semi-rigid and flexible flap further comprises a fifth wall disposed opposite the gate wall to cover the second end of the main body.

In accordance with an aspect of the invention, the elongate pull tab further comprises a mechanical fastener sized, dimensioned, and configured for mechanically fastening the elongate pull tab to a corresponding mechanical fastener disposed on the gate wall in such a way that when fastened locks the strip loader in the fully stowed position inside the main body.

In accordance with an aspect of the invention, the mechanical fastener comprises a hook and loop fastener or a snap.

In accordance with an aspect of the invention, the flexible strip loader frictionally holds ten or fewer cartridges of ammunition.

In accordance with an aspect of the invention, the flexible strip loader impact surface comprises a rounded edge.

In accordance with an aspect of the invention, the holster further comprises a belt clip or sleeve mounted to an exterior face of the first wall. In certain further aspects, the holster further comprises a belt loop hook.

In accordance with an aspect of the invention, the semi-rigid and flexible flap with gate wall is coupled with the main body proximal the first end, the gate wall extending orthogonal to the flap and sized, dimensioned, and configured to cover the second opening at the second end of the main body when the flexible flap is in an un-flexed state, and the gate wall pulled away and sized, dimensioned, and configured to uncover the second opening at the second end of the main body when the flexible flap is in a fully flexed state and wherein pulling on the elongate pull tab causes the strip loader to slide outward from the fully stowed position inside the main body, an impact surface of the strip loader impacting and pushing aside the gate wall of the flexible flap and transitioning the flexible flap from the un-flexed state to the fully flexed state as the strip loader is further extracted from the main body until the strip loader is fully extracted and un-stowed from the main body at which time the flexible flap transitions back to the un-flexed state covering the second opening at the second end of the main body. In accordance with certain other aspects, the semi-rigid and flexible flap further comprises a fifth wall disposed opposite the gate wall to cover the first end of the main body.

In accordance with an aspect of the invention, the main body is formed of plastic or equivalent.

In accordance with another aspect of the invention, the main body is formed of leather.

In accordance with another aspect of the invention, the holster further comprises a second support edge featured on an interior face of the first and/or second side wall between the first end of the main body and the second end of the main body and distal from the horizontal support edge.

In accordance with an aspect of the invention, the semi rigid and flexible flap is formed of plastic.

In accordance with an aspect of the invention, the extended pull tab is formed of leather.

In accordance with another aspect of the invention, the extended pull tab is formed of plastic.

BRIEF DESCRIPTION OF THE FIGURES

These and other characteristics of the present invention will be more fully understood by reference to the following detailed description in conjunction with the attached drawings, in which:

FIGS. 11A, 11B depict different views of an elongate pull tab in accordance with an embodiment of the present invention;

FIGS. 12A, 12B depict different views of an elongate pull tab with various mounted hardware in accordance with an embodiment of the present invention;

DETAILED DESCRIPTION

Figure 1:
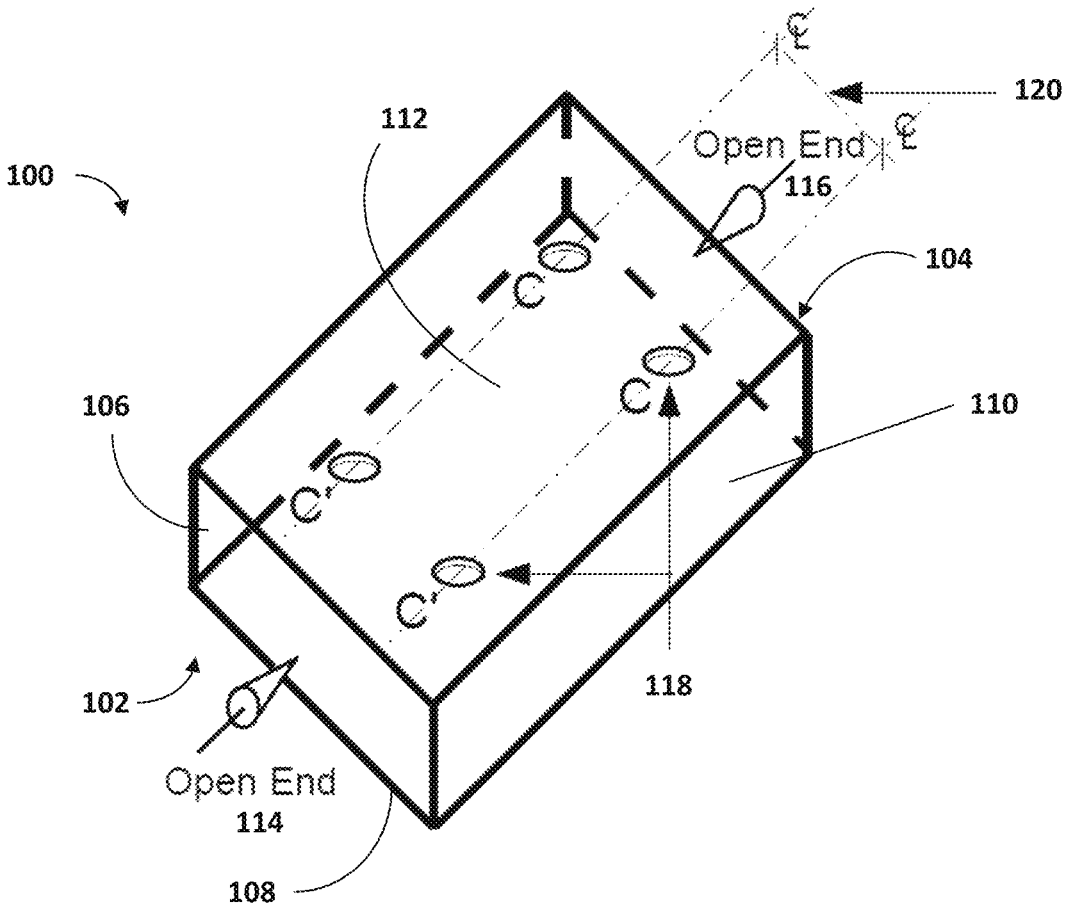
FIG. 1 is an isometric perspective view of the main body of the ammunition holster in accordance with one embodiment of the present invention.

The present invention is directed to an ammunition holster that provides a convenient and discrete system for the storage and rapid deployment of cartridges of ammunition stored in a strip style speed loader. The system includes a main body, the strip loader, an elongate pull tab; and a flexible flap and gate wall. The main body comprises an open ended box sized, dimensioned, and configured to contain and stow a strip loader that is holding cartridges. The elongate pull tab is attached to the tab end of the strip loader to provide a larger gripping area or handle for the extraction of the strip loader from the main body. The flexible flap and gate wall attach to the main body to enclose the open ends of the box of the main body while the flexible nature of the flap allows the gate wall enclosing one open end of the main body to swing away to enable the extraction of the strip loader using the elongate pull tab attached to the strip loader.

FIG. 1 through FIG. 19B wherein like parts are designated by like reference numerals throughout, illustrate an example embodiment or embodiments of an ammunition holster according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 2:
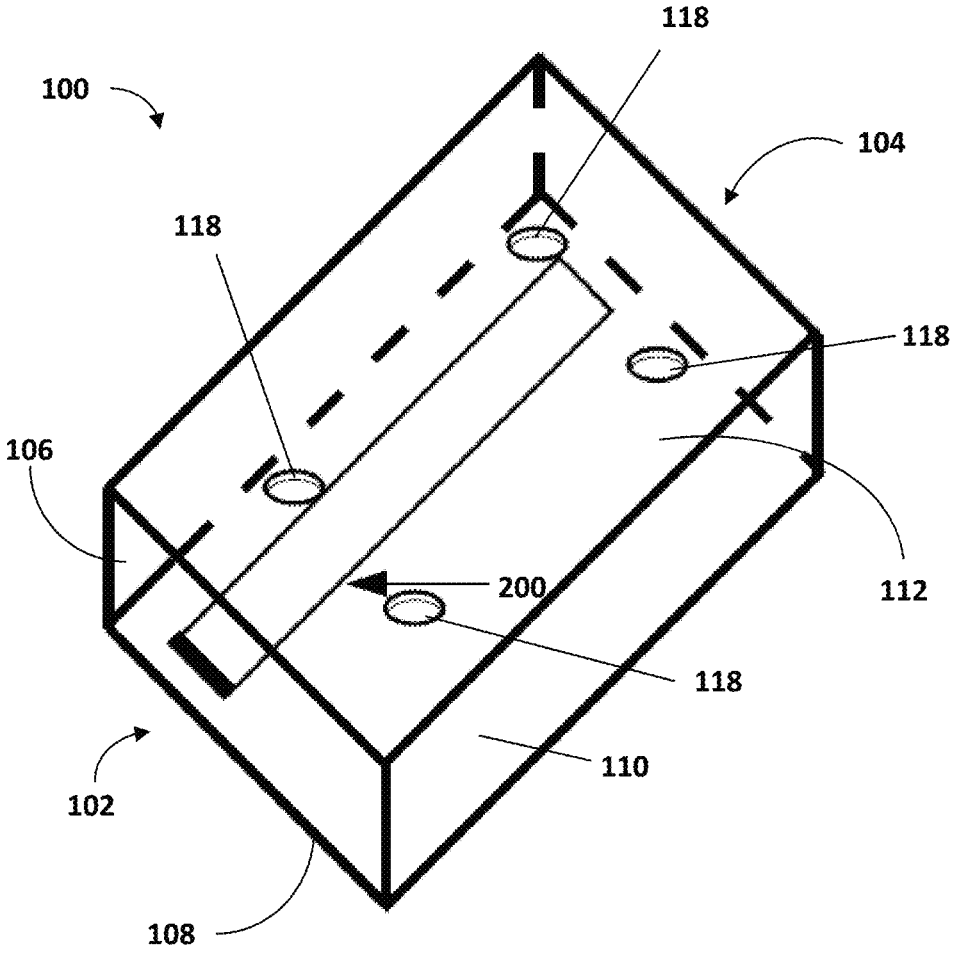
FIG. 2 is an isometric perspective view of the main body of the ammunition holster in depicting a support edge in accordance with one embodiment of the present invention.

FIG. 1 and FIG. 2 depict an isometric perspective view of the main body 100 of the ammunition holster in accordance with one embodiment of the present invention. The main body 100 is generally cuboid shaped having a first end 102, a second end 104 opposite the first end 102, and at least four walls defining an interior volume. The four walls comprise an elongate top wall 106, which intersects with and is generally orthogonal to a first side wall 108, which intersects with and is generally orthogonal to an elongate bottom wall 110, which intersects with and is generally orthogonal to a second side wall 112, which intersects with and is generally orthogonal to the elongate top wall 106, thus forming an enclosed main body 100. The top wall 106 and the bottom wall 110 are opposite each other and generally planar parallel with each other. Similarly, the first side wall 108 and the second side wall 112 are opposite each other and generally planar parallel with each other. The resulting box has a first opening 114 at the first end 102 and a second opening 116 at the second end 104.

The dimensions of the box of the main body 100 vary in relationship to the size of ammunition and corresponding ammunition strip that are being contained in the box or ammunition holster. The main body 100 can be made from a variety of materials. In a preferred embodiment the main body 100 is formed of plastic material, which is semi-rigid and also flexible. In other embodiments, the main body 100 is made of leather. In still other embodiments, the body is formed of plastic or metal that is covered or wrapped in leather. In certain embodiments, the main body 100, including all the various sides, can be formed from one solid piece of material. In other embodiments, the various sides of the main body 100 could be formed individually and connected together during assembly using fasteners or adhesives. This further allows for the use of different material in conjunction in the manufacture, as the various sides could be made of different materials.

In certain embodiments, four holes 118 are provided in the second side wall 106 of the main body 100. In this embodiment, the four holes 118 are divided into two functioning pairs, C-C and C'-C'. Each hole 118 of each pair C-C and C'-C' is spaced from its corresponding pair by the same distance 120. These holes 118 can be used in the orientation and attachment of the flexible flap 600 and gate wall 602 as will be discussed later in this disclosure.

As can be seen in FIG. 2, the main body 100 further includes a horizontal shelf, or support edge 200, featured on an interior face of the first side wall 108 between the first end 102 of the main body 100 and the second end 104 of the main body 100. In the embodiment of FIG. 2 the support edge 200 is located on the interior surface of the first side wall 108 proximal to the top wall 106 and distal from the bottom wall 110. In other embodiments, the support edge 200 is located on an interior face of the second side wall 112 in a manner mirroring a location of the support edge 200 on the interior of the first wall 108. It should be understood by one skilled in the art, that a support edge 200 can be located on the interior surface of either the first side wall 108 or second side wall 112, or both and still provide the desired functionality of supporting a loaded strip loader.

Figure 3A:
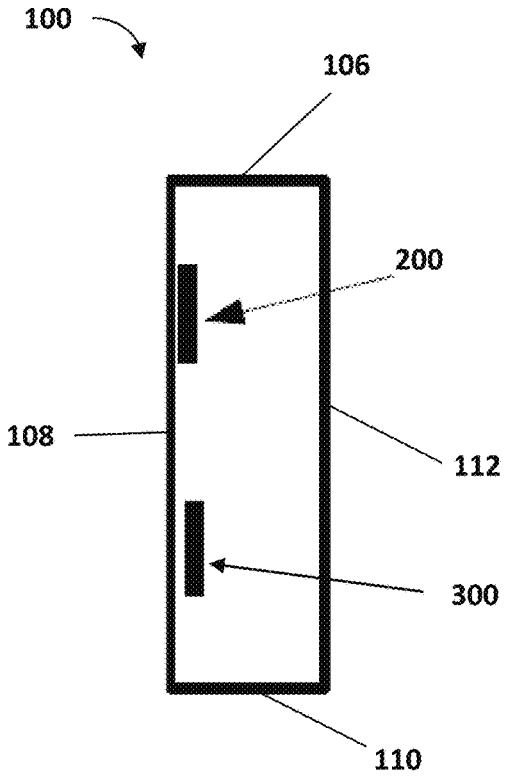
FIGS. 3A, 3B are end views of the interior of the main body as viewed from the first opening of first end in accordance with embodiments of the present invention.
Figure 3B:
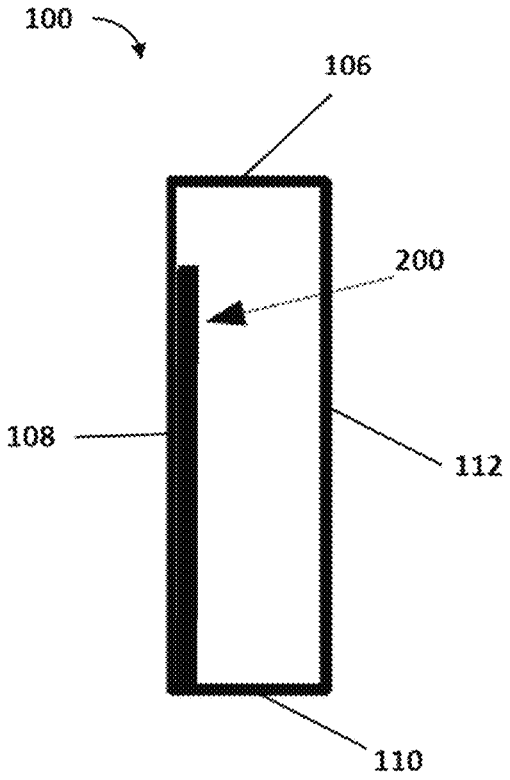

FIGS. 3A and 3B provide an end view of the interior of the main body 100 as viewed from the first opening 114 of first end 102 in accordance with one embodiment of the present invention. In FIG. 3A the horizontal shelf, or support edge 200 can be seen featured on the interior face first side wall 108 of the main body 100. The support edge 200 can also be seen as being proximal to the top wall 106 and distal from the bottom wall 110 on the interior surface of the first side wall 108. As mentioned previously, the support edge 200 could also be located on an interior face of the second side wall 112 in a manner mirroring a location of the support edge 200 on the interior of the first wall 108.

In certain embodiments, the support edge 200 is formed as part of the interior surface of the first side wall 108 or second side wall 112. In other embodiments, the support edge 200 may be attached to or otherwise mounted on the interior surface of the first side wall 108 or second side wall 112. In some such embodiments, the support edge 200 is formed of a strip of leather, or other material extending across the interior surface of the first side wall 108 or second side wall 112, such as resulting from the leather from the bottom wall 110 continuing around and overlapping with the first side wall 108 or second side wall 112. The function of the shelf, or support edge 200, is to provide support for a loaded strip loader and to prevent the loaded strip loader 400 from sagging within the holster 900. This keeps the tips of the ammunition from dragging on the bottom of the case. This eliminates any possibility for jamming and insures that extraction of the ammunition strip will be smooth and efficient. Accordingly, the placement of the support edge 200 in relation to the top wall 106 and bottom wall 110 on the interior surface of the first side wall 108 is based on the size and dimensions of the flexible strip loader 400 that the support edge 200 is meant to support.

In certain embodiments, a second support edge 300 may be provided on the interior face of the first side wall 108 or second side wall 112 distal from the top wall 106 and proximal to the bottom wall 110. Like the first support edge 200, the second support edge 300 can be formed as part of the side wall or mounted thereon. Providing a second support edge 300 in this manner allows the body 100 to be flipped or otherwise rotated 180 degrees while still providing support for a loaded strip loader in the same manner as the first support edge 200. As with the first support edge 200, the placement of the second support edge 300 in relation to the bottom wall 110 and top wall 106 on the interior surface of the first side wall 108 or second side wall 112 is based on the size and dimensions of the flexible strip loader 400 that the second support edge 300 is meant to support. In still other embodiments, as seen in FIG. 3B, the support edge 200 can be sized and shaped to extend along the length of the interior wall (here first side wall 108) such that the relative distance of the support edge 200 from the bottom wall 110 is the same as distance from the top wall 106. In some such embodiments, the support edge 200 is formed of a strip of leather, or other material extending across the interior surface of the side wall, such as resulting from the leather from the bottom wall 110 continuing around and overlapping with the side wall. In such a configuration, the support edge 200 is still capable of providing support for a loaded strip loader 400 when the main body has been flipped or otherwise rotated 180 degrees. An example of a flexible strip loader 400 can be seen in FIG. 4.

Figure 4:
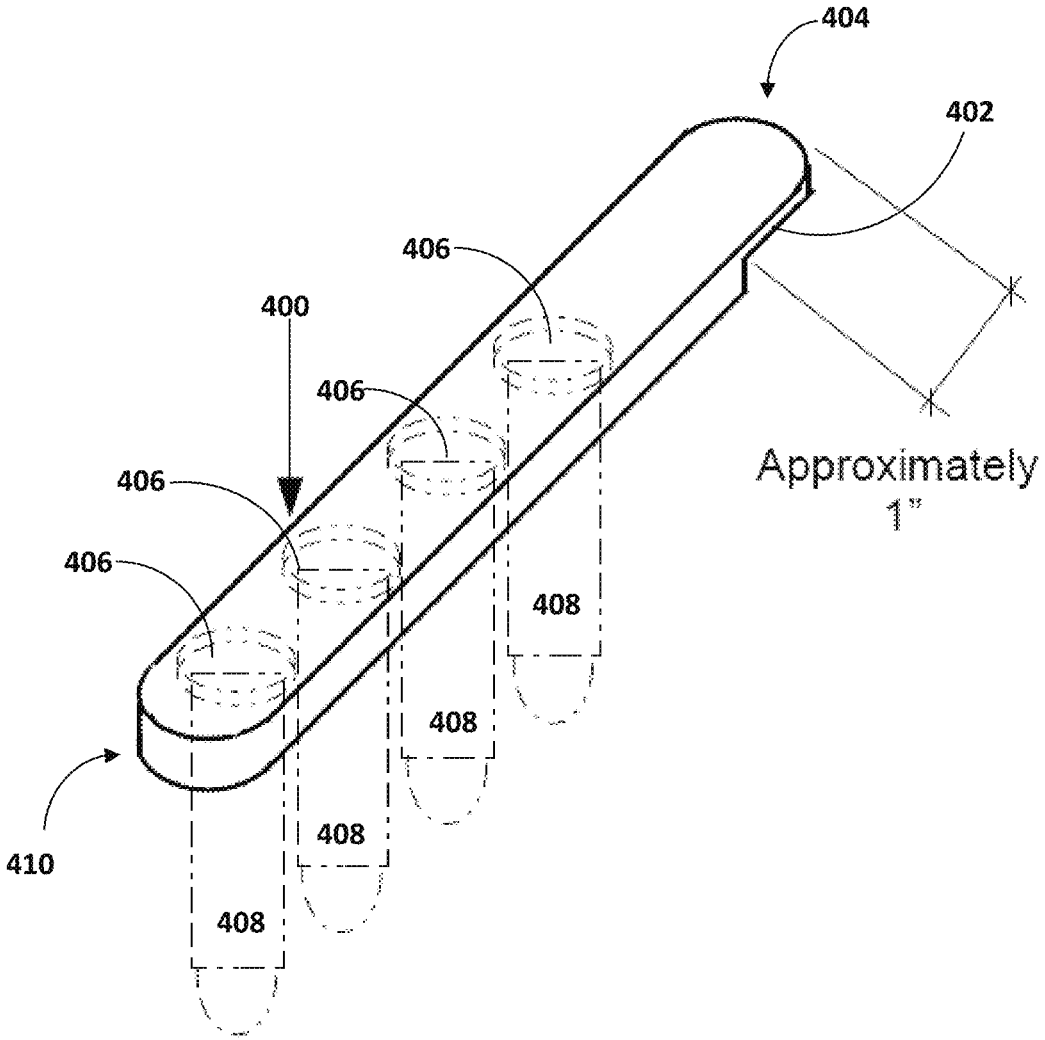
FIG. 4 is an isometric view of a flexible strip loader in accordance with one embodiment of the present invention.

FIG. 4 depicts an isometric view of a flexible strip loader 400 in accordance with one embodiment of the present invention. The flexible strip style speed ammunition loader, referred herein throughout as strip loader 400, consists of a strip of flexible material having a pull tab 402 on a first end 404 of the flexible strip loader 400 and a series of receptacles 406 for receiving and holding one or more cartridges 408 (typically between 5 and 10 cartridges) extending along the body of the flexible strip loader 400 toward a second end 410 of the strip loader 400.

The strip loader 400 is typically made of a flexible material such as rubber, neoprene, or plastic. The flexible nature of the material allows for deformation or flexing to receive and release cartridges 408 loaded into the receptacles 406 of strip loader 400. An example of such a flexible strip ammunition loader, or strip loader 400, is the Speed Strip™ manufactured by Bianchi International. Such strip loaders 400 are sized and dimensioned based on the size or caliber of cartridges 408 to be loaded as well as the number of cartridges 408. In certain embodiments, the strip loader 400 is configured to receive and hold six (6) cartridges 408 when fully loaded with cartridges 408. In other embodiments the strip loader 400 is configured to hold ten (10) cartridges 408 when fully loaded with cartridges 408. It should be apparent to one skilled in the art that other numbers of cartridges 408 or loadings less than the full amount are possible.

The main body 100 is configured, sized and dimensioned such that a flexible strip loader 400 can be removably, replaceably, and slidably mounted inside the interior volume of the main body 100 in a fully stowed position. An example of this can be seen in FIG. 5.

Figure 5:
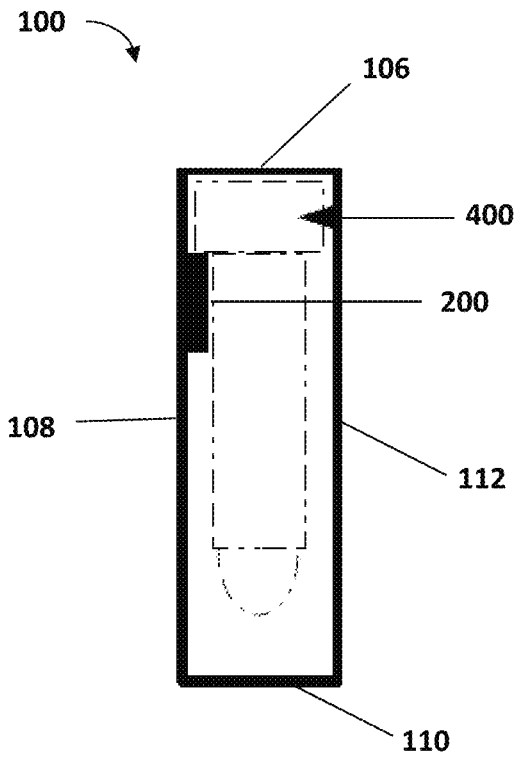
FIG. 5 is an end view of the main body from the first end wherein a flexible strip loader loaded with one or more cartridges is stored in the interior volume of the main body in accordance with an embodiment of the present invention.

FIG. 5 is an end view of the main body 100 from the first end 102 wherein a flexible strip loader 400 loaded with one or more ammunition cartridges 408 is stored in the interior volume of the main body 100 in accordance with an embodiment of the present invention. In this example, the flexible strip loader 400 is supported and positioned by the horizontal support edge 200, and the interior volume of the main body 100 is configured, sized, and dimensioned to receive the flexible strip loader 400 with a plurality of cartridges 408 loaded thereon to be completely enclosed by the main body 100.

Figure 6:
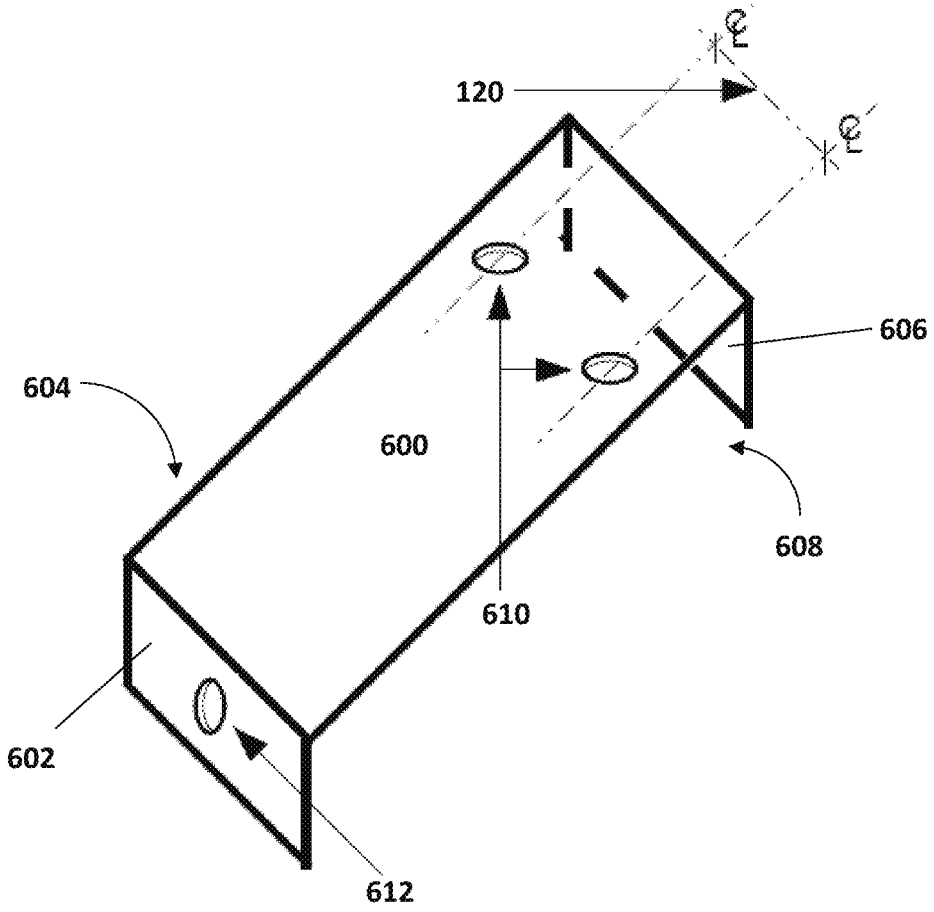
FIG. 6 is an isometric view of the semi-rigid and flexible flap with gate wall in accordance with embodiments of the present invention.

FIG. 6 is an isometric view of the semi-rigid and flexible flap 600 with gate wall 602 in accordance with embodiments of the present invention. In this example, the gate wall 602 extends orthogonally from a first end 604 of the flap 600. The flap 600 may also have a fifth wall 606 extending orthogonally from the second end 608 of the flap 600 wherein the fifth wall 606 is opposite and generally planar parallel to the gate wall 602 at the first end 604 of the flap 600.

In certain embodiments, a pair of holes 610 is provided proximal to the second end 608 of the flap 600. This pair of holes 610 are located and spaced to line up with a pair of the holes 118, either C-C or C'-C', on the main body 100 as seen in FIG. 1. In certain other embodiments, the gate wall 602 is also provided with a mounting hole 612.

The flexible flap 600 and gate wall 602 can be formed of a number of materials that provide the semi-rigid and flexible nature of the flap 600. Suitable materials include plastic and metal. In a preferred embodiment the flap 600 and gate wall 602 are formed of Kydex® plastic or equivalent, for its rugged properties, as well as for being semi-rigid (sufficient to protect the ammunition from minor impact that may be experienced when being worn on the belt of a person) while also sufficiently flexible so as to elastically flex and return to original shape in the manner described herein for the described operation of the inventive ammunition holster 900. In some such embodiments, the flap 600 and gate wall 602 are formed of plastic or metal and covered or wrapped in leather. In certain embodiments, the flap 600 and gate wall 602 (as well as the fifth wall 606) can be formed from one solid piece of material. In still further embodiments, the flap 600 and gate wall 602 (as well as fifth wall 606 can be formed as part of the same whole as the main body 100. In other embodiments the flap 600 and gate wall 602 (as well as the fifth wall 606) could be formed individually and connected together during assembly using fasteners or adhesives. This further allows for the use of different materials in the manufacture of the flap 600 and gate wall 602, as the various elements could be made of different materials.

The semi-rigid and flexible flap 600 as well as the gate wall 602 are sized and configured to be fitted over and mounted on the main body 100 such that the gate wall 602 encloses one of the openings 114, 116 at either end of the main body 100. An example of this can be seen in FIG. 7.

Figure 7:
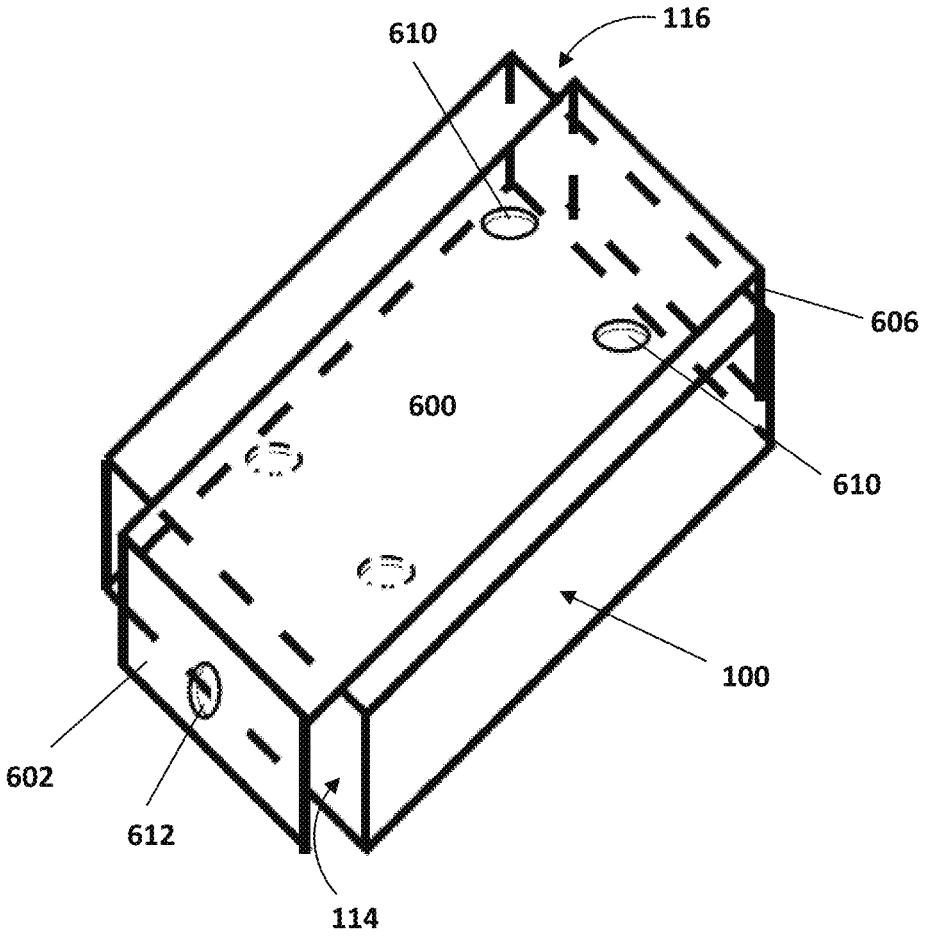
FIG. 7 is an isometric view of the semi-rigid and flexible flap and gate wall fitted over the main body in accordance with an embodiment of the present invention.

FIG. 7 is an isometric view of the semi-rigid and flexible flap 600 and gate wall 602 fitted over the main body 100 in accordance with an embodiment of the present invention. In this example, the flap 600 and gate wall 602 are fitted over the main body 100 such that the gate wall 602 covers the first opening 114 at the first end 102 of the main body 100. In embodiments where the flap 600 also has a fifth wall 606 opposite and generally planar parallel to the gate wall 602, the fifth wall 606 can cover the second opening 116 at the second end 104.

When the flap 600 and gate wall 602 of FIG. 6 are fitted over the main body 100 in the manner shown in FIG. 7, the pair of holes 610 provided on the flap 600 align with the pair of holes C-C 118 provided on the second side wall 112 of the main body 100 as seen in FIG. 1. This allows the flap 600 to be coupled or otherwise attached to the main body 100 using the holes 610 provided on the flap 600 and the holes C-C, 118 on the main body 100. An example of this can be seen in FIG. 8.

Figure 8:
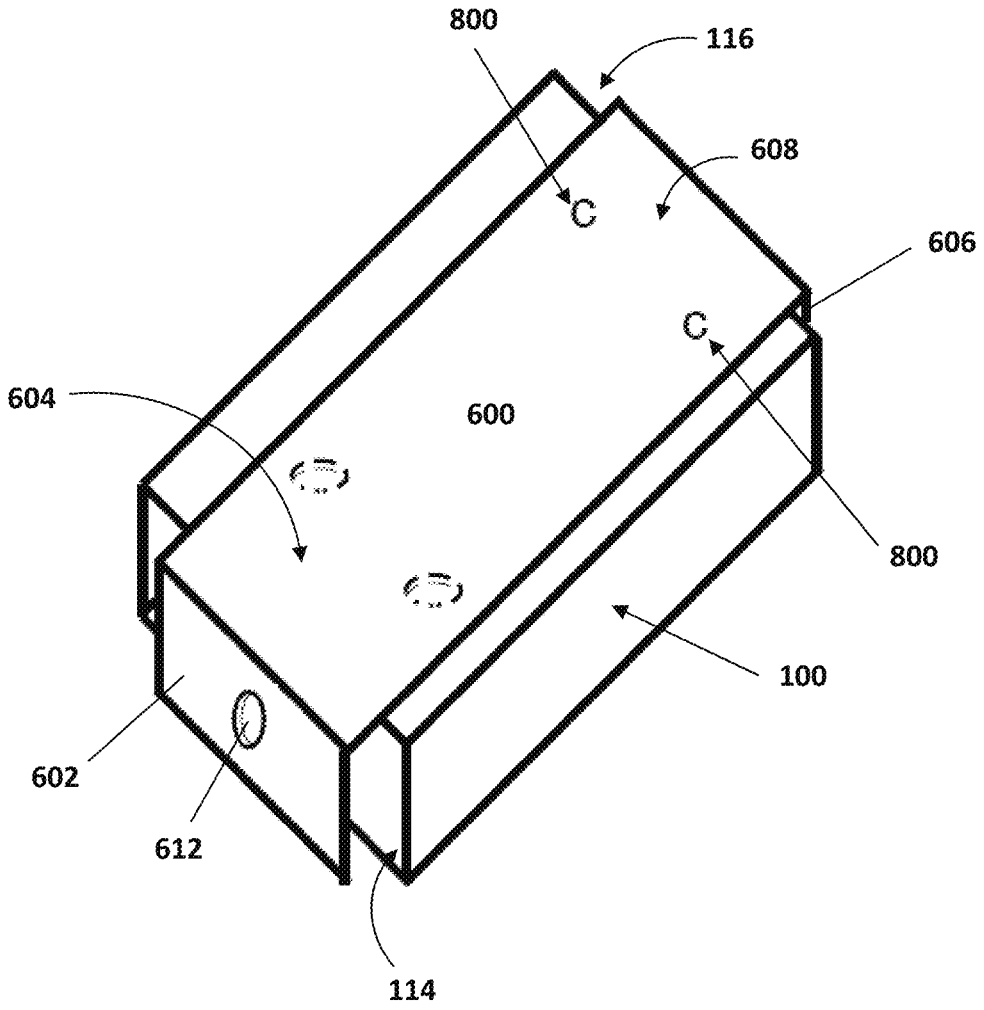
FIG. 8 is an isometric view of the semi-rigid and flexible flap and gate wall coupled to the main body in accordance with an embodiment of the present invention.

FIG. 8 is an isometric view of the semi-rigid and flexible flap 600 and gate wall 602 coupled to the main body 100 in accordance with an embodiment of the present invention. In this example the flap 600 is coupled to the main body 100 by the use of fasteners 800 in conjunction with the aligning holes C-C 118 of the main body 100 and the holes 610 of the flap 600. Examples of suitable fasteners 800 include, but are not limited to: bolts and nuts, screws, snaps, and rivets. Other suitable fasteners will be apparent to one skilled in the art given the benefit of this disclosure.

It will be apparent to one skilled in the art given the benefit of this disclosure that the semi-rigid and flexible flap 600 can be rotated and oriented such that the pair of holes 610 align with the pair of holes C'-C' 118 of the main body 100 wherein the gate wall 602 would function to cover second opening 116 at the second end 104 of the main body 100 and the fifth wall 606 would in turn cover the first opening 114 at the first end 102. The operation of the flap 600 and gate wall 602 would be the same but just on the opposite end of the main body 100. In certain embodiments, the fasteners 800 used to couple the flap 600 to the main body 100 are removable for easier reconfiguration. This allows the ammunition holster 900 to be configured to be used by either hand of a user by simply removing the fasteners 800, rotating the flap 600 and gate wall 602 assembly, and recoupling the flap 600 to the main body 100 with the fasteners 800 using the other pair of provided holes 118.

In other embodiments, where a second support edge 300 is provided or the support edge 200 extends along interior length to the first wall 108 to have the same spacing in relation to the top wall 106 and bottom wall 110, the semi rigid and flexible flap 600 and gate wall 602 do not need to be flipped to reconfigure the ammunition holster 900 for either hand, as the holster 900 as a whole can be flipped. In such embodiments, the flap 600 can be permanently attached or formed as one piece with the main body 100.

When the flap 600 is coupled to the main body 100 the flexible nature of the flap 600 allows for the gate wall 602 to uncover the first opening 114 at the first end 102 of the main body 100 when the flap 600 is in a flexed state. This allows for the extraction of a strip loader 400 which has been stored and enclosed in the interior of the main body 100. After the strip loader 400 is extracted, the flap 600 returns to its unflexed state where the gate wall 602 once again covers the first opening 114 at the first end 102 of the main body 100. An example of this can be seen in FIG. 9 and FIG. 10A-10C.

Figure 9:
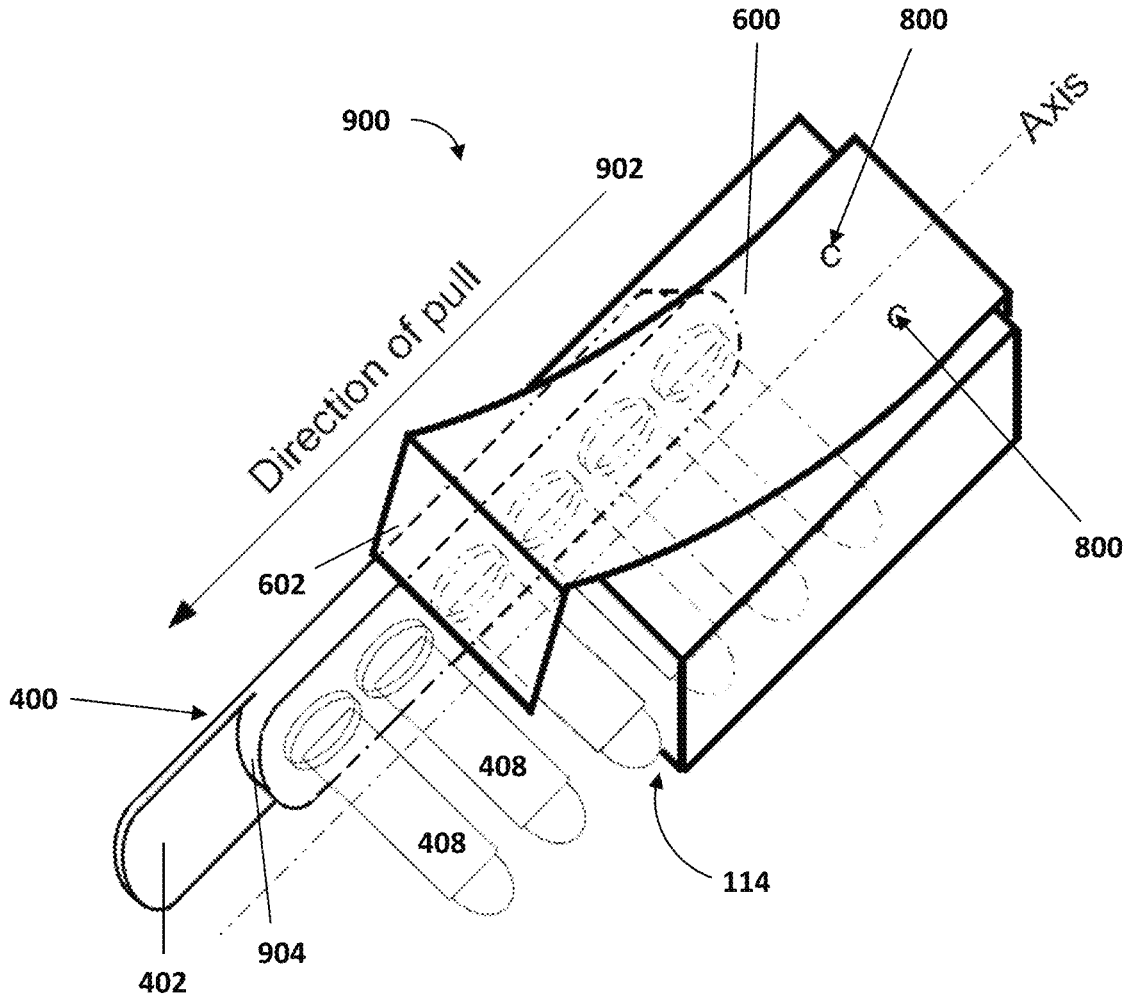
FIG. 9 is an isometric view of the ammunition holster where the flap is being transitioned to a flexed state where the gate wall is moved out of the way to uncover the first opening of the first end of the main body allowing for the extraction of a stowed strip loader from the interior of the main body in accordance with an embodiment of the invention.

FIG. 9 depicts an isometric view of the ammunition holster 900 where the flap 600 is being transitioned to a flexed state where the gate wall 602 is moved out of the way to uncover the first opening 114 of the first end 102 of the main body 100 allowing for the extraction of a stowed strip loader 400 from the interior of the main body 100. In this example, the strip loader 400 is pulled in the direction indicated by arrow 902 using pull tab 402 so as to extract the strip loader 400 from the first opening 114 of the first end 102 of the main body 100. During extraction, as the strip loader 400 slides out along the support edge 200 (or in some embodiments, second support edge 300), an impact surface 904 of the strip loader 400 comes into contact with the gate wall 602. The impact of the impact surface 904 with the gate wall 602 pushes the gate wall 602 out of the way thus transitioning the flap 600 from an un-flexed state to a flexed state. After the strip loader 400 is fully extracted and un-stowed from the main body 100, the flap 600 is allowed to return to its un-flexed state wherein the gate wall 602 covers the first opening 114 of the first end 102 of the main body 100.

Figure 10A:
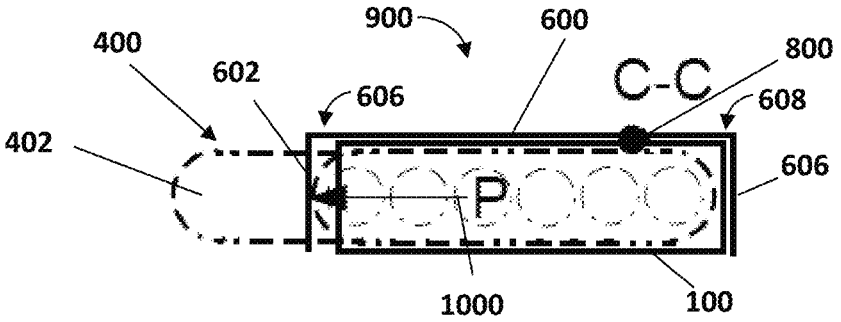
FIGS. 10A, 10B, 10C depict bottom views of the holster during extraction as the strip loader transitions from being stowed in the ammunition holster to being un-stowed in accordance with an embodiment of the present invention.
Figure 10B:
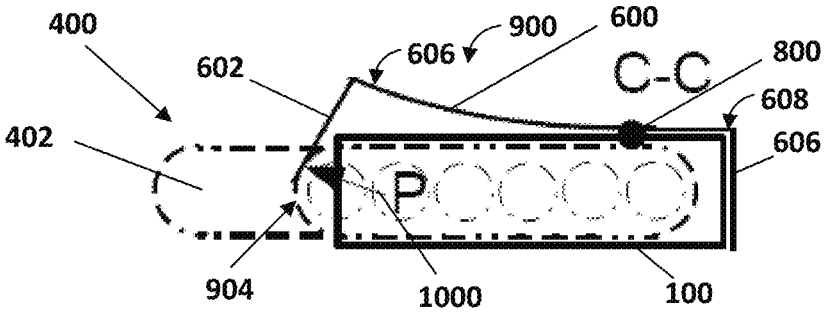
Figure 10C:
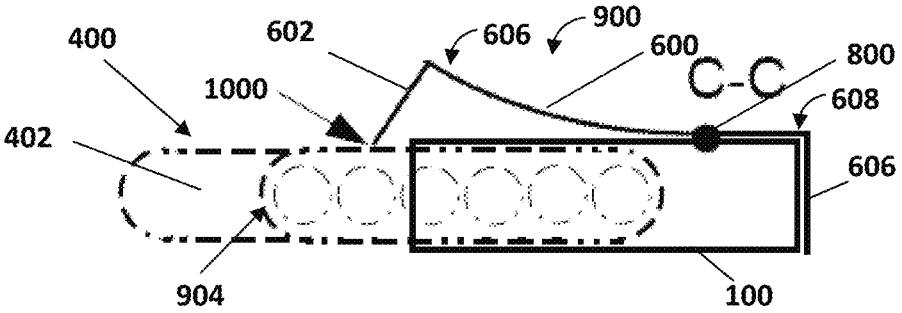

FIGS. 10A-10C depict bottom views of the holster 900 during extraction as the strip loader 400 transitions from being stowed in the ammunition holster 900 to being un-stowed. FIG. 10A shows the strip loader 400 fully stowed with the flap 600 in an un-flexed state where the gate wall 602 is covering the first opening 114 of the first end 102 of the main body 100. As the strip loader 400 is slid out from the holster 900, the impact surface 904 of the strip loader 400 comes into contact with the gate wall 602 applying a force at point P 1000. FIG. 10B shows the strip loader 400 as it begins to emerge from the holster 900. Because fasteners 800 couple the second end 608 of the flap 600 to the second end 104 of the main body 100 with fasteners 800 at the second end 608 of the flap 600, when force is applied to the gate wall 602 by the impact surface 904, the gate wall 602 moves out of the way laterally causing the flap 600 to transition to a flexed state. FIG. 10C shows the flap 600 in a fully flexed state where the first opening 114 is uncovered by the gate wall 602.

In certain embodiments, such as shown in FIG. 9 and FIG. 10A-10C, the impact surface 904 of the strip loader 400 comprises a rounded edge that further assists in the moving of the gate wall 602 and extraction of the strip loader 400 as the rounded edge allows the point of contact P 100 between impact surface 904 and the gate wall 602 to smoothly transition from a center of the gate wall 602, as seen in FIG. 10A, to the edge of the gate wall 602, as seen in FIG. 10C, without catching or snagging as the gate wall 602 moves away from the first opening 114 and the strip loader 400 slides past the gate wall 602.

While the extraction of the strip loader 400 as seen in FIG. 9 and FIG. 10A-10C is affected by the pulling of the pull tab 402 of the strip loader 400, as mentioned previously, one limitation typically of strip style loaders 404, such as the Speed Strip™ by Bianchi International, is that the provided pull tab 402 is relatively small. The provided pull tab 402 is typically only around one (1) inch (2.54 cm) in length. This can cause users, especially users with larger hands, to have difficulty gripping and handling the flexible strip loader 400. As such, the ammunition holster 900 of the present invention provides an elongate pull tab 1100 that extends the size and gripping area of the provided pull tab 402. An example of this can be seen in FIGS. 11-14.

FIGS. 11A-11B depict different views of an elongate pull tab 1100 in accordance with an embodiment of the present invention. The elongate pull tab 1100 is designed to extend the gripping area of the provided pull tab 402 of the strip loader 400, as such; the elongate pull tab 1100 has similar dimensions of thickness and width as the provided pull tab 402 while having a greater length. The front view of the elongate pull tab 1100 in FIG. 11A shows the relative width as well as the increased length as compared to the provided pull tab 402. The front view of FIG. 11A also show the various mounting holes 1102, 1104, 1106, 1108 provided in the elongate pull tab 1100 for mounting various hardware on the elongate pull tab 1100. The side view of FIG. 11B shows the relative length as well as the relative thickness of the elongate pull tab 1100. The center lines of the various holes 1102, 1104, 1106, and 1108 are also indicated. In certain embodiments, the extended pull tab 110 is made of leather. In other embodiments, the extended pull tab is made of plastic or metal. In still other embodiments, the pull tab 110 ins made of plastic or metal that is covered or wrapped in leather. Other suitable materials will be apparent to one skilled in the art given the benefit of this disclosure.

FIGS. 12A-12B depict different views of an elongate pull tab 1100 with various mounted hardware in accordance with an embodiment of the present invention. The front view of FIG. 12A shows the various hardware mounted in holes 1102, 1104, 1106, 1108 provided in the elongate pull tab 1100. In the first hole 1102, a mechanical fastener is provided for attaching the elongate pull tab 1100 to the provided pull tab 402 of the strip loader 400. In the second hole 1104, a releasable fastener, 1202 is provided for releasably attaching the elongate pull tab 1100 to the gate wall 602. The third hole 1106 and fourth holes 1108 allow for the mounting of additional grip elements 1204. The side view of FIG. 12B shows how the various hardware 1200, 1202, and 1204 is mounted on the elongate pull tab 1100.

The mechanical fastener 1200 in the first hole 1102 is used to attach the elongate pull tab 1100 to the provided pull tab 402 of the strip loader 400. Since the material of the strip loader 400 is flexible and relatively soft, a user should be able to make a hole in the provided pull tab 402 of the strip loader 400 using basic tools. A mechanical fastener can then be threaded through the first hole 1102 of the elongate pull tab 1100 and the user made hole in the provided pull tab 402 of the strip loader 400 to couple or otherwise attach the elongate pull tab 1100 to the provided pull tab 402 of the strip loader 400. The provided pull tab 402 can be seen bent 90 degrees and attached to the elongate pull tab 1100 by the mechanical fastener in FIG. 12B. Suitable fasteners include, but are not limited to: bolts and nuts, rivets, and other permanent or semi-permanent fasteners.

The releasable fastener 1202 mounted in the second hole 1104 of the elongate pull tab 1100 allows the elongate pull tab 1100 to be releasably attached to an outer surface of the gate wall 602 when the strip loader 400 attached to the elongate pull tab 1100 is stowed in the holster 900. In this example, the female half of a snap closure, is mounted in the second hole 1104 that can be mated with the male counterpart of the snap closure mounted in hole 612 provided in gate wall 602 (not shown). Other possible suitable releasable fasteners will be apparent to one skilled in the art given the benefit of this disclosure.

The final piece of hardware mounted on the elongate pull tab 1100 is a grip element 1204 that assists a user in gripping the elongate pull tab 1100 when in use. In the example of FIG. 12A and FIG. 12B, the grip element 1204 comprises two rubbery washers mounted on both sides of the elongate pull tab 1100 through the third hole 1106 using a removable fastener, such as a nut and bolt. The washers act as a positive stop for the fingers of a user when pulling on the elongate pull tab 1100. Other possible grip elements and removable fasteners will be apparent to one skilled in the art given the benefit of this disclosure. In certain embodiments, the grip element 1204 can be moved to the fourth hole 1108 to provide an additional configuration for a user.

Figure 13:
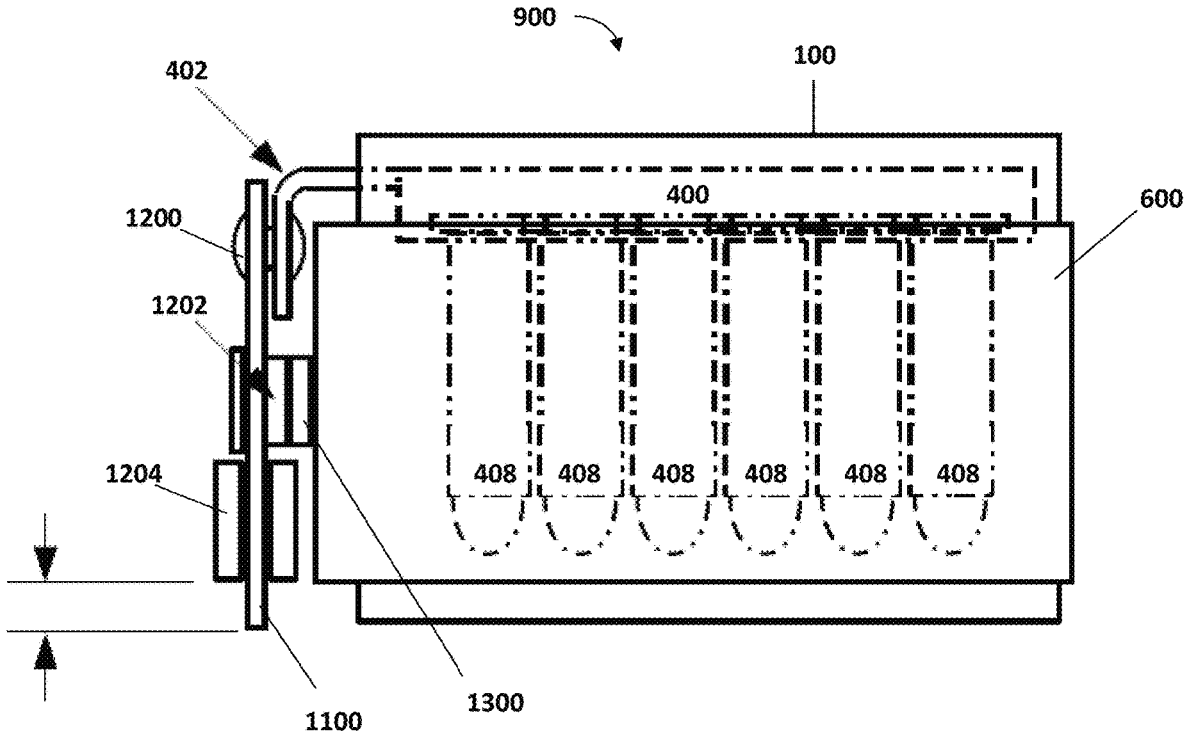
FIG. 13 is a side view of the holster with the elongate pull tab attached to the provided pull tab at a first end of the strip loader in accordance with an embodiment of the present invention.
Figure 14:
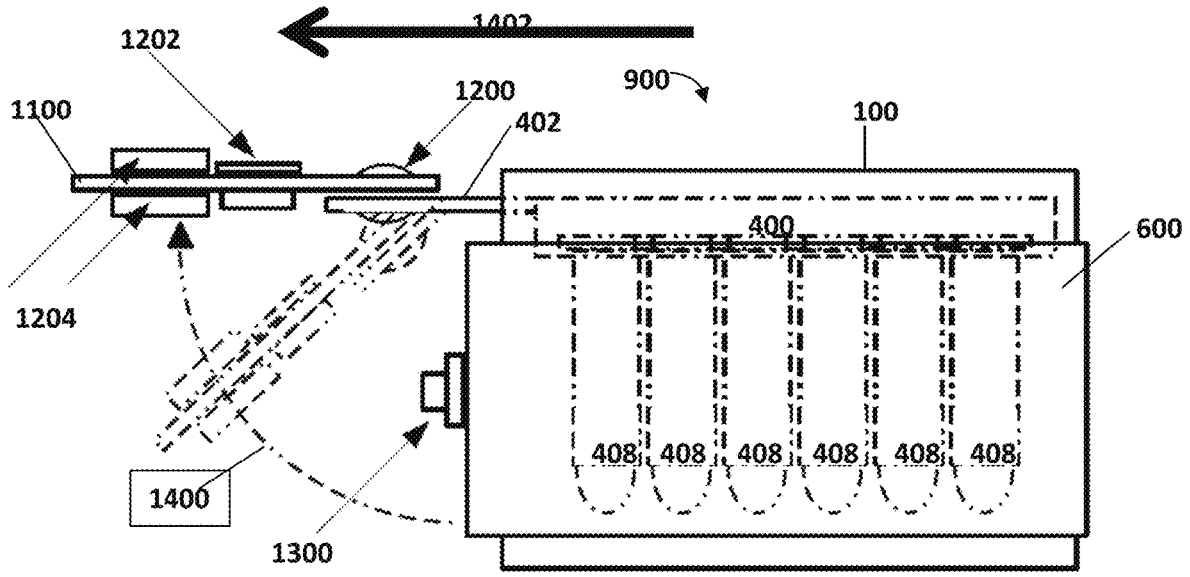
FIG. 14 is a side view of the holster with the elongate pull tab attached to the provided pull tab at a first end of the strip loader in accordance with an embodiment of the present invention.

FIG. 13 and FIG. 14 depict a side view of the holster 900 with the elongate pull tab 1100 attached to the provide pull tab 402 of the strip loader 400 in accordance with an embodiment of the present invention. As can be seen in these examples, when a loaded strip loader 400 is fully stored in the main body 100 of the holster 900, the elongate pull tab 1100 is configured to extend outside the interior volume of the main body 100.

In the example of FIG. 13, the elongate pull tab 1100 is shown in a stowed and secured position. Here, the flexible nature of the strip loader 400 allows the provided pull tab 402 of the strip loader 400 to bend perpendicular to the orientation of the strip loader 400 positioning the elongate pull tab 1100 so as to align substantially parallel to the gate wall 602. The elongate pull tab 1100 is secured in this position and alignment by the releasable fastener 1202 mounted in hole 1104 of the elongate pull tab 1100. In this example, the provided female half of a snap fastener 1202 is engaged with a male portion of a snap fastener 1300 mounted in hole 612 in the gate wall 602 to "snap" the elongate pull tab 1100 into the stowed and secured position.

FIG. 14 depicts the transition of the elongate pull tab 1100 from the stowed and secured position to a deployment position wherein the elongate pull tab 1100 is used to pull or otherwise extract the loaded strip loader 400 from the holster 900. In operation, a user uses their fingers to engage and grip the elongate pull tab 1100 using the provided grip elements 1204. The user then disengages or "unsnaps" the releasable fastener 1202 and swings the elongate pull tab 1100 from the relatively perpendicular orientation of the stowed and secured position shown in FIG. 13 to a relatively horizontal position in line with the orientation of the strip loader 400 as indicated by the arrow 1400 depicting the arc of the swing motion. As the elongate pull tab 1100 transitions to the relatively horizontal position, the elongate pull tab 1100 can be used to pull or otherwise extract the strip loader 400 from the interior of the main body 100 of the holster 900 in the pull direction indicated by the arrow 1402 past the gate wall 602, which is in turn pushed out of the way by the impact surface 904 of the strip loader 400 as facilitated by the flexing of the flap 600.

Figure 16A:
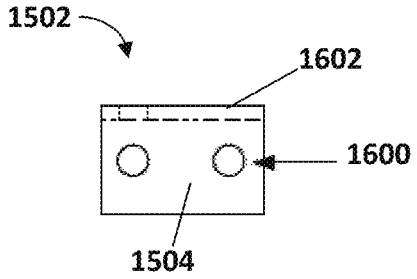
FIGS. 16A, 16B, 16C, 16D, 16E depict various views of the first part and second part of the belt clip of FIGS. 15A, 15B in accordance with an embodiment of the present invention.
Figure 16C:
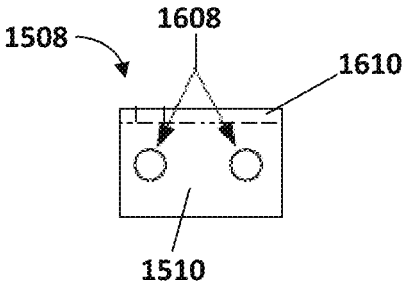
Figure 16B:
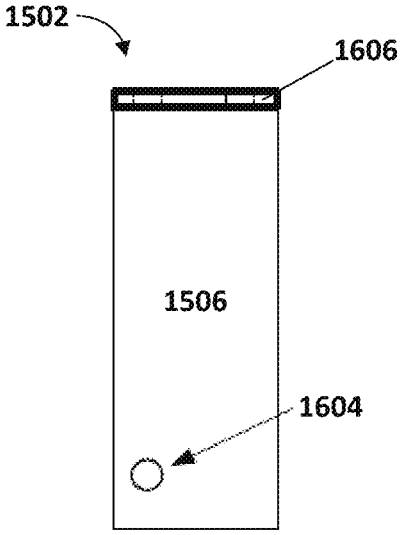
Figure 16D:
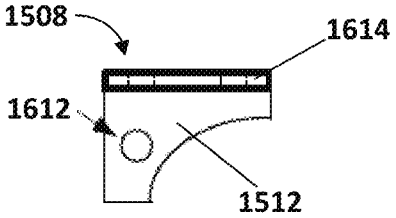
Figure 16E:
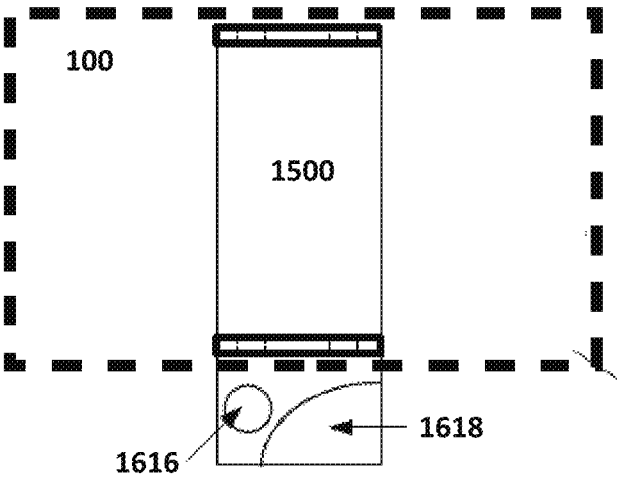
Figure 17:
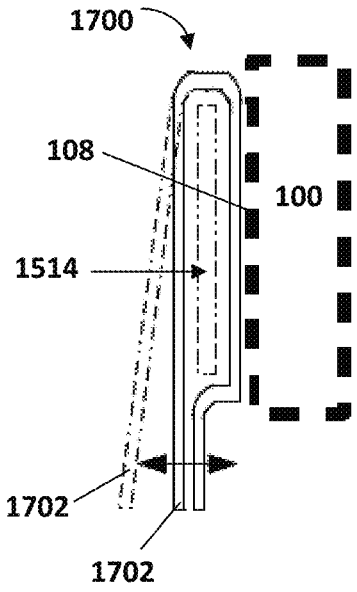
FIG. 17 is a side view of an alternate belt clip in accordance with an embodiment of the present invention.
Figure 18:
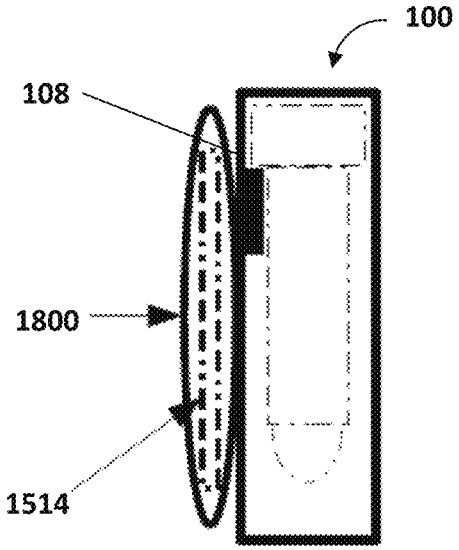
FIG. 18 is a side view of a belt sleeve in accordance with an embodiment of the present invention.
Figure 19A:
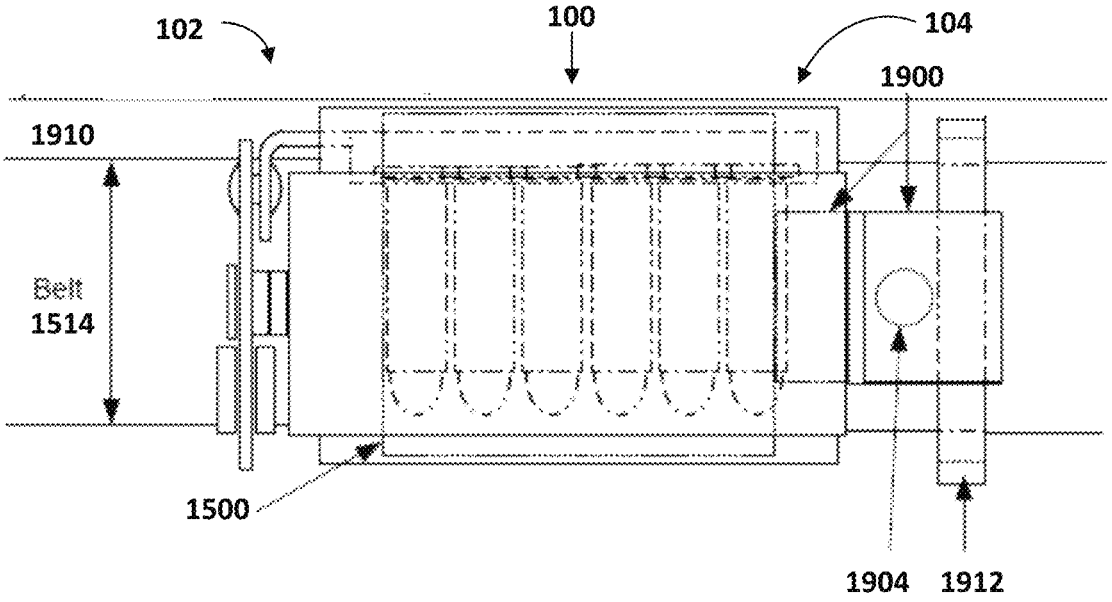
FIGS. 19A, 19B depict various views of a belt loop hook in accordance with an embodiment of the present invention.
Figure 19B:
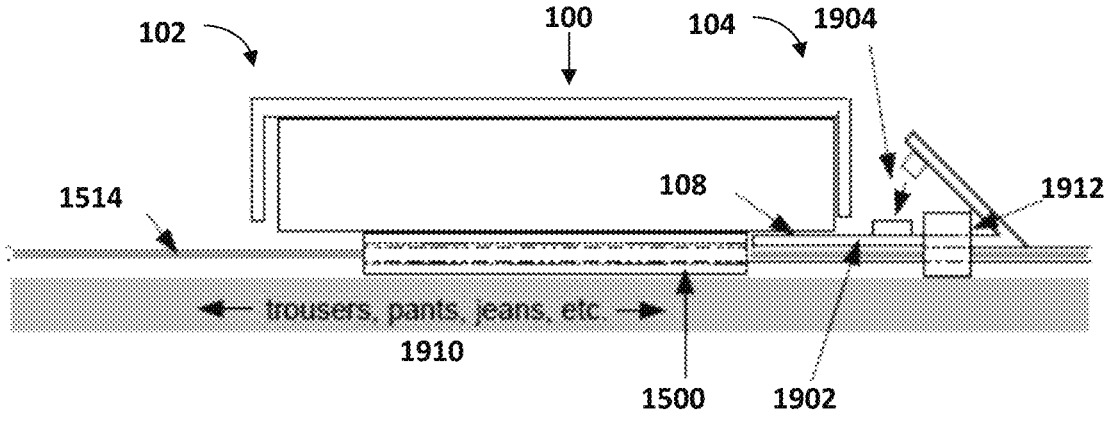

FIG. 15 through FIG. 19B relate to mounting the holster 900 on a belt 1514 of a user in accordance with various embodiments. FIG. 15A and FIG. 15B depict the use of one configuration of a belt clip 1500 in accordance with one embodiment of the present invention. FIG. 16 depicts various perspective views of the parts of the belt clip 1500 of FIG. 15A and FIG. 15B in accordance with one embodiment of the present invention. FIG. 17 depicts an alternate design of a belt clip 1700 in accordance with embodiments of the present invention. FIG. 18 depicts a belt sleeve in accordance with one embodiment of the present invention. FIG. 19A and FIG. 19B depict an example belt loop hook 1800 used to fix the holster 900 in position on a belt.

Figure 15A:
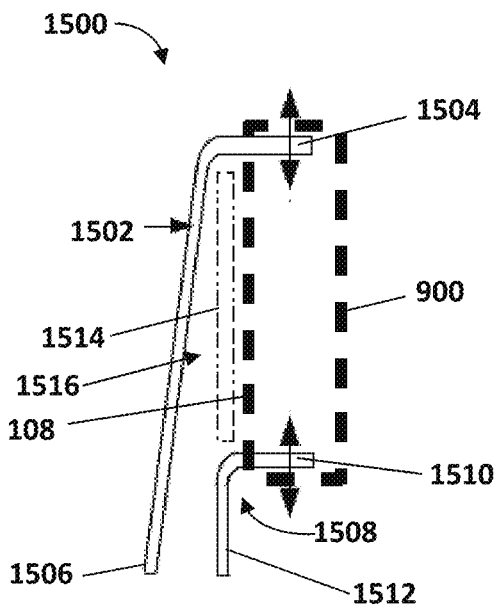
FIGS. 15A, 15B depict the use of one configuration of a belt clip in accordance with one embodiment of the present invention.
Figure 15B:
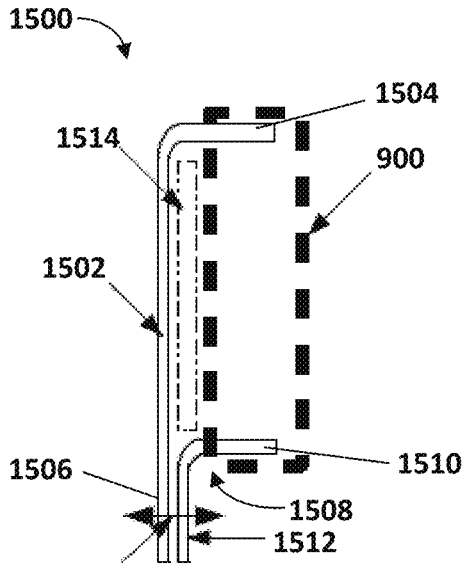

In the example to FIG. 15A and FIG. 15B the belt clip 1500 is provided on the exterior surface of the first side wall 108 of the main body 100 of the holster 900. The belt clip 1500 comprises two parts comprising right angle flanges of different configurations. The right-angle flange of first part 1502 of the belt clip 1500 has first extension 1504 configured to align with and attach to the top wall 106 of the main body 100 and second extension 1506 that extends along the first side wall 108 of the main body 100 in a generally planar parallel manner. The right-angle flange of second part 1508 of the belt clip 1500 has a first extension 1510 configured to align with and attach to the bottom wall 110 of the main body 100 and a second extension 1512 that extends away from the main body 100 in a manner that is generally planar parallel to the first side wall 108. The second extensions 1506, 1512 of both the first part 1502 and the second part 1508 are configured to overlap and align such that a belt 1514 can be captured and contained in a space between the second extension 1506 of the first part 1502 and the first side wall 108 of the main body 100.

In certain embodiments, the first part 1502 and/or second part 1508 of the belt clip 1500 are formed of a semi-rigid flexible material, such a plastic or metal, that allows the parts to flex in order to create an opening 1516 for the insertion of a belt 1514 into the space configured to capture and contain the belt 1514.

In FIG. 15A, the first part 1502 of belt clip 1500 is flexed so at to move the second extension 1506 of the first part 1502 away from the first side wall 108 of the main body 100 to create an opening 1516 for the insertion of a belt 1514. In FIG. 15B, the first part 1502 of the belt clip 1500 has been un-flexed capturing the belt 1514 between the second extension 1506 of the first part 1502 of the belt clip 1500 and the first side wall 108 of the main body 100.

FIGS. 16A-16E depict various views of the first part 1502 and second part 1508 of the belt clip 1500 of FIG. 15 in accordance with an embodiment of the present invention.

FIG. 16A is top view of the first part 1502 depicting the first extension 1504 of the first part 1502. In this example the first extension 1504 further includes holes 1600 for attaching the first part 1502 to the top wall 106 of the main body 100 of the holster 900. Not shown in this figure is the second extension 1506 extending at a right angle from an edge 1602 of the first extension 1504.

FIG. 16B is a front view of the first part 1502 depicting the second extension 1506 of the first part 1502. In this example the second extension 1506 further includes a hole 1604 for securing the second extension 1506 of the first part 1502 to the second extension 1512 of the second part 1508 to secure a belt 1514. Not shown in this figure is the first extension 1504 extending at a right angle from an edge 1606 of the second extension 1506.

FIG. 16C is top view of the second part 1508 depicting the first extension 1510 of the second part 1508. In this example the first extension 1510 further includes holes 1608 for attaching the second part 1508 to the bottom wall 110 of the main body 100 of the holster 900. Not shown in this figure is the second extension 1512 extending at a right angle from an edge 1610 of the first extension 1510.

FIG. 16D is a front view of the second part 1508 depicting the second extension 1512 of the second part 1508. In this example the second extension 1512 further includes a hole 1612 for securing the second extension 1512 of the second part 1508 to the second extension 1506 of the first part 1502 to secure a belt 1514. Not shown in this figure is the first extension 1510 extending at a right angle from an edge 1614 of the second extension 1512.

FIG. 16E is a front view of the belt clip 1500 mounted on the main body 100 of the holster 900. As can be seen in this example, when the first part 1502 and the second part 1508 of the belt clip 1500 are both secured to the main body 100, the second extensions 1506, 1512 align such that the provided holes 1604, 1612 line up providing a pass-through 1616 that receive a fastener to secure the first part 1502 to the second part 1508 to secure a belt 1514. In addition, the configurations of the second extensions 1506, 1512 further provide a tab 1618 that can be used to flex the first part 1502 away from the main body 100 as seen in FIG. 15A.

FIG. 17 depicts a side view of an alternate belt clip 1700 in accordance with an embodiment of the present invention. In this example, instead of two parts, as with the belt clip 1500 of FIG. 15 and FIG. 16, the belt clip 1700 is one solid part. The clip 1700 can be mounted on the first side wall 108 of the main body 100 and receive and enclose a belt 1514 by flexing an outer extension 1702 away from the main body 100 and allowing the outer extension 1702 to return to its un-flexed position.

FIG. 18 depicts a side view of a belt sleeve 1800 in accordance with an embodiment of the present invention. Like the belt clips 1500 and 1700 of FIGS. 15-17 the sleeve is mounted to the first side wall 108 of the main body 100. Unlike the belt clips 1500 and 1700 of FIGS. 15-17, the belt sleeve 1800 does not have a bottom opening 1516 into which the belt 1514 can be inserted. Instead the belt sleeve 1800 requires a user to thread their belt 1514 though the belt sleeve 1800 to mount the holster 900 on the user's belt 1514.

The sleeve 1800 may be formed of a material that is rigid or flexible in nature such as metal, plastic, rubber, or leather. In certain embodiments, the sleeve 1800 can be formed as part of the main body 100 of the holster 900. In other embodiments, the sleeve 1800 can be formed separately from the main body 100 and attached using fasteners, adhesives, or other attachment means.

FIG. 19A depicts a front view of a belt loop hook 1900 in accordance with an embodiment of the present invention. The belt loop hook 1900 is designed to work in conjunction with belt clip 1500 or belt sleeve 1800 and prevent the holster 900 from sliding or otherwise moving along a belt 1514 onto which the holster 900 has been mounted using the belt clip 1500 or sleeve 1800. The belt loop hook 1900 accomplishes this by encapsulating or otherwise hooking to a belt loop 1912 of the user's pants 1910 thereby anchoring or otherwise fixing the location of the holster 900 in proximity to the selected belt loop 1912 of the user's pants 1910.

As can be seen in the front view of FIG. 19A and the bottom view of FIG. 19B, the belt loop hook 1900 extends from the main body 100 of the holster 900 and is designed and configured to capture or otherwise hook onto a belt loop 1912 of a user's pants 1910. In this example the belt loop hook is mounted on the first side wall 108 of the main body 100 along with the belt clip 1500 or belt sleeve 1800. The belt loop hook 1900 is designed to be mounted on the end of the main body 100 opposite from the flexible flap 600 and gate wall 602. So in embodiments where the gate wall 602 covers and encloses the first end 102 of the main body 100 of the holster 900, the belt loop hook would extend out from the second end 104. Mounting the belt loop hook 1800 opposite the flexible flap 600 and gate wall 602 allows the belt loop hook to act as an anchor against the force applied to the holster 900 when the strip loader 400 is extracted from the holster 900 to prevent the holster from sliding along the user's belt 1514.

In this example, the belt loop hook 1900 comprises a tether 1902 and reusable fastener such as snap closure 1904. The tether is made of a relatively flat and flexible material such as leather, plastic, or rubber and is sized and dimensioned to be slid through a belt loop 1912. The flexible nature of the material allows the tether 1902 to be folded or bent back over the belt loop 1912 through which the tether 1902 has been inserted to encapsulate or hook the belt loop 1910. The encapsulation or hooking of the belt loop 1912 is secured using the snap closure 1904 as shown in FIG. 19B. Other suitable means for hooking or securing the belt loop will be apparent to one skilled in the art given the benefit of this disclosure.

In certain embodiments, wherein the tether 1902 is made of the same material as the main body 100, the tether 1902 can be formed as part of the main body 100 of the holster 900. In other embodiments, the tether 1902 may be separate from the main body 100 and attached using adhesive, fasteners or other attachment means allowing the tether 1902 to be made of a different material that the main body 100. In still other embodiments, the belt loop hook 1900 could be part of or attached to the belt clip 1500 or sleeve 1800. Other possible configurations, materials, and attachment means will be apparent to one skilled in the art given the benefit of this disclosure.

The ammunition holster 900 of the present invention provides a belt mounted location that is much more readily accessible than putting the loaded strip style loader in a pocket. Further, when extracted, the strip style loader is in the closest proximity to the firearm ready for loading. In use, a natural hand motion with no contortions required places the elongate pull tab, or extension, of the strip loader in the hand in such a way that extraction is optimized. Once extracted, the elongate pull tab and strip loader are in the perfect hand position for loading.

The ammunition holster of the present invention provides a discrete, minimalistic, lightweight and durable mechanism for holding and dispensing a strip loader. The operable flap is reversible enabling the case to be worn on the left side and drawn with the right hand; right side and drawn with the left hand; and in the small of the back drawn with either hand. The contents of the holster are very secure. Because of the 90 degree corners of the gate wall and operable flap, it is extremely difficult to shake the contents out of the case—they must be extracted by intentionally pulling on the pull tab thereby forcing the gate wall open from the inside by applying pressure with the rounded impact surface of the strip loader when it is drawn out of the holster during extraction.

To any extent utilized herein, the terms "comprises" and "comprising" are intended to be construed as being inclusive, not exclusive. As utilized herein, the terms "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may be existing in the upper and lower limits of the ranges of subjective or objective values, such as variations in properties, parameters, sizes, and dimensions. In one non-limiting example, the terms "about" and "approximately" mean at, or plus 10 percent or less, or minus 10 percent or less. In one non-limiting example, the terms "about" and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. An ammunition holster, comprising:

a generally cuboid shaped main body having a first end, a second end opposite the first end, and at least four walls defining an interior volume, the at least four walls comprising:

an elongate top wall, which intersects with and is generally orthogonal to a first side wall, which intersects with and is generally orthogonal to an elongate bottom wall, which intersects with and is generally orthogonal to a second side wall, which intersects with and is generally orthogonal to the elongate top wall, thus forming an enclosed main body;

wherein the top wall and the bottom wall are opposite each other and generally planar parallel with each other; and wherein the first side wall and the second side wall are opposite each other and generally planar parallel with each other;

a horizontal support edge featured on an interior face of at least one of the first side wall and second side wall between the first end of the main body and the second end of the main body;

a first opening at the first end of the main body;

a rubbery and flexible strip loader removably, replaceably, and slidably mounted inside the interior volume of the main body in a fully stowed position, the strip loader supported and positioned by the horizontal support edge, and the interior volume being configured, sized, and dimensioned, to receive the strip loader with a plurality of cartridges of ammunition loaded thereon to be completely enclosed by the main body;

an elongate pull tab extending from a first end of the strip loader, the elongate pull tab sized, dimensioned, and configured in such a way as to extend outside of the interior volume when the strip loader is in the fully stowed position inside the main body;

a semi-rigid and flexible flap with gate wall coupled with the main body proximal the second end, the gate wall extending orthogonal to the semi-rigid and flexible flap and sized, dimensioned, and configured to cover the first opening at the first end of the main body when the semi-rigid and flexible flap is in an un-flexed state, and the gate wall pulled away and sized, dimensioned, and configured to uncover the first opening at the first end of the main body when the semi-rigid and flexible flap is in a fully flexed state;

wherein pulling on the elongate pull tab causes the strip loader to slide outward from the fully stowed position inside the main body, an impact surface of the strip loader impacting and pushing aside the gate wall of the semi-rigid and flexible flap and transitioning the semi-rigid and flexible flap from the un-flexed state to the fully flexed state as the strip loader is further extracted from the main body until the strip loader is fully extracted and un-stowed from the main body at which time the semi-rigid and flexible flap transitions back to the un-flexed state covering the first opening at the first end of the main body.

2. The holster of claim 1, wherein the semi-rigid and flexible flap further comprises a fifth wall disposed opposite the gate wall to cover the second end of the main body.

3. The holster of claim 1, wherein the elongate pull tab further comprises a mechanical fastener sized, dimensioned, and configured for mechanically fastening the elongate pull tab to a corresponding mechanical fastener disposed on the gate wall in such a way that when fastened locks the strip loader in the fully stowed position inside the main body.

4. The holster of claim 3, wherein the mechanical fastener comprises a hook and loop fastener or a snap.

5. The holster of claim 1, wherein the strip loader frictionally holds ten or fewer cartridges of ammunition.

6. The holster of claim 1, wherein the strip loader impact surface comprises a rounded edge.

7. The holster of claim 1, further comprising a belt clip mounted to an exterior face of the first side wall.

8. The holster of claim 7, further comprising a belt loop hook mounted to an exterior face of the first side wall.

9. The holster of claim 1, further comprising a belt sleeve mounted to an exterior face of the first side wall.

10. The holster of claim 9, further comprising a belt loop hook mounted to an exterior face of the first side wall.

11. The holster of claim 1, wherein the semi-rigid and flexible flap with the gate wall is coupled with the main body proximal the first end, the gate wall extending orthogonal to the semi-rigid and flexible flap and sized, dimensioned, and configured to cover a second opening at the second end of the main body when the semi-rigid and flexible flap is in an un-flexed state, and the gate wall pulled away and sized, dimensioned, and configured to uncover the second opening at the second end of the main body when the semi-rigid and flexible flap is in a fully flexed state and wherein pulling on the elongate pull tab causes the strip loader to slide outward from the fully stowed position inside the main body, an impact surface of the strip loader impacting and pushing aside the gate wall of the semi-rigid and flexible flap and transitioning the semi-rigid and flexible flap from the un-flexed state to the fully flexed state as the strip loader is further extracted from the main body until the strip loader is fully extracted and un-stowed from the main body at which time the semi-rigid and flexible flap transitions back to the un-flexed state covering the second opening at the second end of the main body.

12. The holster of claim 11, wherein the semi-rigid and flexible flap further comprises a fifth wall disposed opposite the gate wall to cover the first end of the main body.

13. The holster of claim 1, wherein the main body is formed of plastic.

14. The holster of claim 1, wherein the main body is formed of leather.

15. The holster of claim 1, wherein the main body is formed of plastic covered in leather.

16. The holster of claim 1, further comprising a second support edge featured on an interior face of at least one of the first side wall and second side wall between the first end of the main body and the second end of the main body and distal from the horizontal support edge.

17. The holster of claim 1, wherein the semi-rigid and flexible flap is formed of plastic.

18. The holster of claim 1, wherein the semi-rigid and flexible flap is formed of plastic covered in leather.

19. The holster of claim 1, wherein the extended pull tab is formed of leather.

20. The holster of claim 1, wherein the extended pull tab is formed of plastic.

21. The holster of claim 1, wherein the extended pull tab is formed of plastic covered in leather.

* * * * *